United States Patent [19]

Granholm

[11] 4,006,783

[45] Feb. 8, 1977

[54] HYDRAULIC OPERATED ROCK DRILLING APPARATUS

[75] Inventor: Sven Granholm, Skelleftea, Sweden

[73] Assignee: Linden-Alimak AB, Skelleftea, Sweden

[22] Filed: Mar. 17, 1975

[21] Appl. No.: 558,688

[52] U.S. Cl. ..... 173/12; 60/420; 91/170 R; 91/412; 173/105; 173/115

[51] Int. Cl.² ..... E21C 3/20

[58] Field of Search ..... 173/2, 10, 11, 12, 105, 173/115; 60/420; 91/412, 61, 170

[56] References Cited

UNITED STATES PATENTS

| | | | |
|---|---|---|---|
| 3,189,103 | 6/1965 | Ahcbo et al. | 173/11 |
| 3,408,901 | 11/1968 | Inhofer | 91/412 X |
| 3,679,179 | 7/1972 | Praddande | 91/412 X |
| 3,701,386 | 10/1972 | Feucht | 173/78 |
| 3,774,502 | 11/1973 | Arndt | 91/300 |
| 3,800,664 | 4/1974 | Phillips | 91/305 |
| 3,822,752 | 7/1974 | Montabert | 173/12 |
| 3,823,784 | 7/1974 | Feucht | 173/11 |

*Primary Examiner*—Ernest R. Purser
*Assistant Examiner*—William F. Pate, III
*Attorney, Agent, or Firm*—Cushman, Darby & Cushman

[57] ABSTRACT

A rock drilling apparatus comprises a hydraulically rotated drill, a percussion motor having a piston which transfers impact energy to the drill, the piston defining together with the machine housing first and second pressure chambers for receiving pressure liquid to move the piston, the percussion motor having a hydraulic circuit including a high pressure side and a low pressure side, a pressure liquid distributing valve having a control input for receiving a control pressure, the distributing valve being located in the hydraulic circuit of the percussion motor for alternately connecting at least one of the pressure chambers to the high pressure side and low pressure side, respectively, of the hydraulic circuit in response to the control pressure, the hydraulic circuit for rotating the drill being separate from the hydraulic circuit of the percussion motor and including a high pressure side and a low pressure side separate from the high and low pressure sides of the percussion motor, a control valve for controlling the control pressure in response to the pressure at the high pressure side of said rotary motor.

18 Claims, 8 Drawing Figures

HYDRAULIC OPERATED ROCK DRILLING APPARATUS

The present invention relates to a drilling apparatus for drilling in rock, concrete or other similar material, comprising a hydraulically operated percussion motor and a hydraulically operated rotary motor.

Rock drilling machines with separate rotational drive are previously known. In these machines the rotary motor for the drill steel is mounted on the machine at the side of the percussion motor.

FIELD OF INVENTION AND PRIOR ART

Depending on the characteristics of the rotary motor and to location thereof a gear transmission is required between the drill steel and the rotary motor. This transmission transmits to the drill steel a rotary speed and a torque depending on the characteristics of the rotary motor.

The percussion motor comprises a reciprocating piston which, accelerated by a pressure fluid, strikes the drill steel, and one or more valves for distributing pressure liquid to pressure chambers defined by the piston and the machine housing. When a liquid is used as pressure fluid, the compressibility of which is very low in comparison with gases, pressure accumulators are required in the high pressure line and possibly also in the low pressure line. The object thereof is to maintain the pressure as constant as possible in the supply and discharge lines and in the channels of the machine housing.

The percussion and rotary motors of the rock drilling machines are generally provided with separate hydraulic circuits, each comprising at least one pump, a pressure limiting valve, a rotary direction determining valve and supply and discharge channels. Filters and oil tank may, however, be in common. Rotary motors of lock drilling machines generally have a fixed displacement. By controlling the liquid flow the rotary speed may be changed. Also the percussion motors generally have a fixed displacement but percussion motors are also known, in which the ratio between impact frequency and liquid flow can be changed by changing the stroke strength.

The pressure present in the high pressure line of the rotary motor depends on the resistance to rotation of the drill. For drilling in hard, homogenous rocks the torque required is relatively low and thus, also the working pressure is low. This is due to the fact that the penetration of the drill is mainly caused by the impact energy during drilling in hard rocks, while the rotation of the drill only serves to rotate the drill bit a predetermined angle between each impact. In most rocks an optimum value can be found for the angle or rotation of the drill steel between each impact in relation to the penetration of the drill.

When the optimum value varies to a large extent with the characteristics of the rocks, it is advantageous to be able to control the rotary speed of the drill steel in relation to the impact frequency. This can be performed by means of a flow control valve in the hydraulic circuit of the rotary motor or by means of a pump with a variable displacement.

During drilling in "soft" rocks the rotary movement of the drill also assists directly in causing the penetration of the drill. The frictional resistance between the rock and the drill bit will, however, be larger, since the drill bit will penetrate deeper at each impact. For this reason the torque required will be larger and, consequently, also the working pressure of the rotary motor.

If the drill, during drilling in hard or homogenous rocks, suddenly enters a zone of soft or fissured rock, the risk is great that the drill will jam due to rapidly increasing resistance to rotation. The combination of the impacts and the great torque may cause such stresses that the drilling steel will break.

The risk of jamming can be reduced substantially by reducing the impact energy transferred by the piston at the impact. The impact energy may be controlled by controlling the stroke length and/or the working pressure of the piston. In construction known up to the present the stroke length can be changed by means of replacement of certain components of the machine or by means of manual adjustment of an adjustment screw by means of a special tool. It is evident that by such means it is not possible to prevent jamming of the drill effectively.

It is also known that the drill operator, in order to aviod jamming of the drill, by means of a manually operated valve can restrict or completely close the supply of pressure fluid to the percussion motor or reduce the feeding force.

Presently a drill operator has often three or four machines to operate simultaneously and the risk of jamming of a drill is therefore considerably larger than previously, when the drill operator had only one or two machines.

Manual actions, however, have most frequently proved to be too slow to prevent jamming of the drill. Withdrawing a jammed drill steel is troublesome and time and work consuming. In addition it will often occur that the drill has to be left in the bore, since it is impossible to loosen it by means of accessible tools.

A method of solving the problems combined with jamming of the drill is previously known, according to which the hydraulic circuits of the rotary motor and the percussion motor are connected in series. The liquid first flows through the rotary motor, delivering a fraction of the pressure energy thereof for the rotary movement of the drill, and then further through the percussion motor, wherein the rest of the pressure energy is utilized. Since the same flow is passing through both motors, this fact prevents control of the ratio between the impact and rotary movements, said control being desirable during drilling in rocks with different properties. If, on the other hand, a bypass valve is used between the motors, said valve allowing a certain control of said ratio by admitting a certain portion of the flow to pass to the low pressure side, a reduced efficiency will be caused in the system, since the pressure energy in the bypassing pressure liquid is converted into heat.

The series connection of the hydraulic circuits also prevents the use of conventional motors for the rotary movement due to sealing difficulties caused by the high pressures at the discharge side of the rotary motor.

Another problem is connection with drilling in rock occurs in long-hole drilling. During long-hole drilling the resistance to rotation of the drill increases with the length of the bore, at the same time as successively increasing impact enery must be supplied to the drill bit via the long drill.

SUMMARY OF THE INVENTION

An object of the present invention is to provide a rock drilling machine, wherein i.a., the disadvantages mentioned above have been eliminated, and which allows an automatic control of the impact energy, so that the risk of drill jamming is considerably reduced.

An other object is to provide a rock drilling machine, wherein the impact energy is automatically increased with increasing rotary resistance during long-hole drilling.

The above-mentioned and other objects have been attained by means of a rock drilling apparatus, comprising a machine housing, means for mounting a drill in said housing, a hydraulically operated rotary motor for rotating said drill, a percussion motor with an impact piston hydraulically operable to perform a power stroke to and a return stroke from said drill for transferring impact energy thereto, said piston defining together with said machine housing first and second pressure chambers for receiving pressure liquid to move said piston to and from the drill, respectively said rotary motor and said percussion motor having separate hydraulic circuits including each a high pressure side and a low pressure side, and a pressure liquid distributing valve located in the hydraulic circuit of the percussion motor for alternately connecting at least one of said pressure chambers to the high pressure side and low pressure side of the hydraulic circuit characterized by a control valve for controlling the amount of driving energy supplied with the pressure liquid to the impact piston via the distributing valve in response to the pressure at the high pressure side of the hydraulic circuit of the rotary motor.

BRIEF DESCRIPTION OF THE DRAWINGS

The invention will now be described more closely below with reference to the attached drawings, on which FIG. 1 and 2, in part schematically, illustrate two different embodiments of the rock drilling machine according to the present invention, FIG. 3, in part schematically, illustrates a modification of the machine according to FIG. 2, and FIG. 4 through 8 schematically illustrate further modification.

In the various illustrations the same reference numerals have been used to indicate the same or similar details.

DESCRIPTION OF PREFERRED EMBODIMENTS

Figure 1:
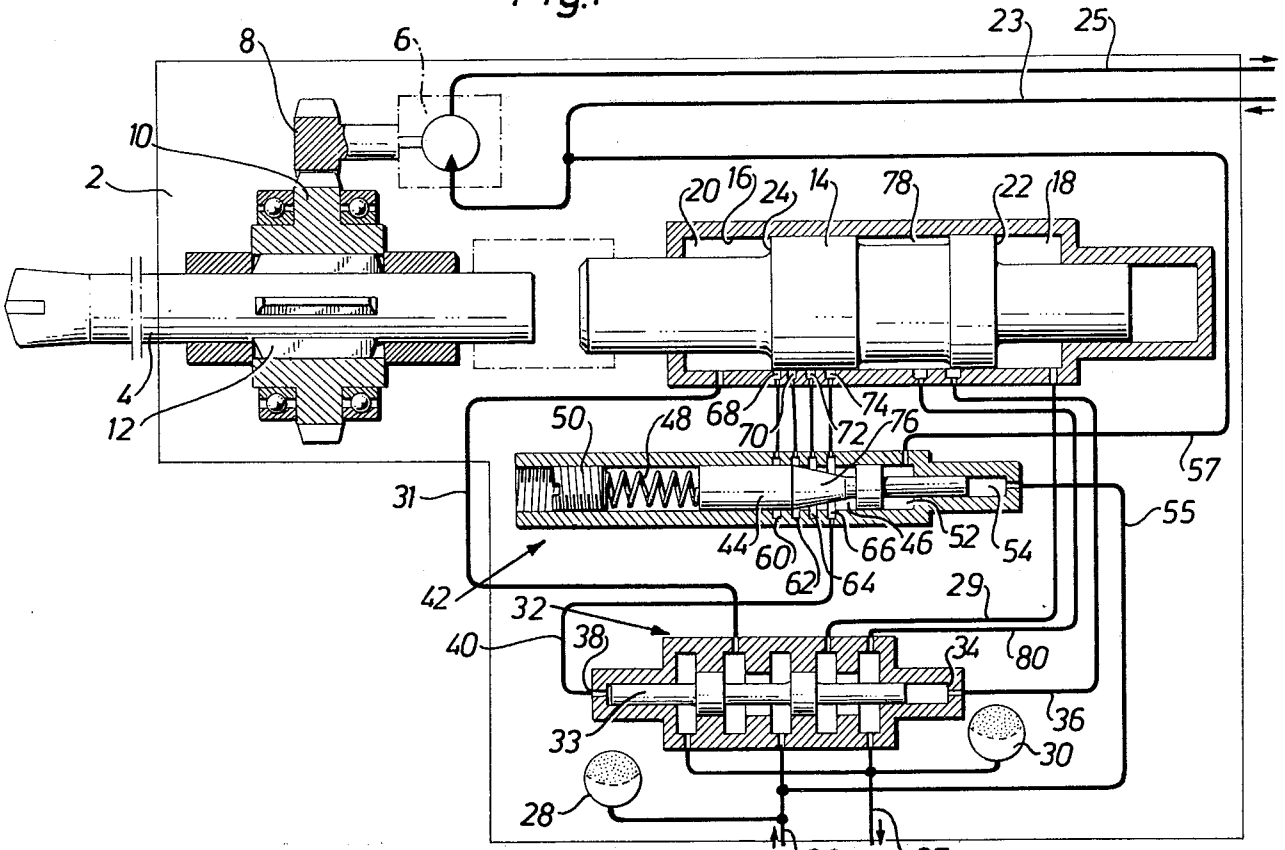

In FIG. 1 a machine housing for the rock drilling machine has been indicated by full lines 2. In the housing 2 a drill steel 4 is demountable inserted. The drill steel 4 is adapted to be rotated by means of a rotary motor 6, shown only schematically, via a gear transmission 8, 10 and a splined bushing 12.

An impact piston 14 is reciprocable in a direction towards the drill 4 in a cylinder chamber 16 in the machine housing 2. More particularly the piston 14 is adapted to hit the drill steel 4 in a manner described more closely below so as to thereby transfer impact energy thereto.

The piston 14 defines a rearward annular pressure chamber 18 and a forward annular pressure chamber 20 in the cylinder space 16. The pressure in the rear chamber 18 acts upon a piston area 22 so as to move the piston in a direction towards the drill, the working stroke, and the pressure in the chamber 20 acts upon a piston area 22 so as to move the piston in a direction towards the drill, the working stroke, and the pressure in the chamber 20 acts upon a piston area 24 in order to move the piston in a direction away from the drill, the return stroke.

The hydraulic circuit of the rotary motor has a high pressure line 23 and a low pressure line 25. In order to open the thread joints of the drill string it is necessary that the rotary motor 6 could be given a reverse rotary direction, which is performed by means of a rotary direction determining valve, not shown.

The rotary motor and the percussion motor have separate hydraulic circuits. The hydraulic circuit of the percussion motor is supplied with pressure liquid through a high pressure channel 26, to which a pressure accumulator 28 is connected. The hydraulic circuit of the percussion motor further comprises a return channel 27 connected with a pressure accumulator 30. The pressure accumulators 28 and 30 may be of a construction known per se so as to outbalance pressure variations. The channels 26 and 27 are connected to a distributing valve of slide type, generally referenced 32 and comprising a valve slide 33. The distributing valve acts, in a manner described below, so as to bring the two pressure chambers 18 and 20, respectively, alternately in connection with the high pressure duct 26 and the discharge duct 27 via channels 29 and 31. When the chamber 18 is brought into communication with the high pressure channel 26, the chamber 20 is simultaneously connected to the low pressure or return channel 27. The liquid pressure in the chamber 18 will impart to the piston 14 an accelerated movement in a forward direction. After impact of the piston against the drill steel 4 the chamber 20 is brought into connection with the high pressure channel 26 and the chamber 18 in connection with the low pressure channel 27, whereby the piston will be displaced rearwardly. The valve slide 33 is hydraulically controlled in one direction at a pressure input 34 via a channel 36, the impact piston 14 operating as a control valve in a manner described below, and in the opposite direction the valve slide 33 is likewise hydraulically controlled at a pressure input 38 via a channel 40, by means of a control valve, generally referenced 42.

The control valve 42 comprises a valve slide 44, which is axially movable in a cylinder space 46 and biased in one direction by means of a compression spring 48 acting on one end of the slide. An adjustment screw 50 is provided for adjusting the pressure of the spring 48. At the opposite end of the slide 44 two separate pressure chambers 52 and 54, respectively, are provided. Pressures occurring in the chambers 52 and 54 act against a slide area each with a force opposing the force of the spring 48. The chamber 54 is via a channel 55 in direct communication with the high pressure channel 26 and the chamber 52 is connected via a channel 57 to the high pressure side, i.e., the channel 23, of the hydraulic circuit of the rotary motor 6.

The cylinder space 46 of the control valve 42 has a number of annular grooves 60, 62, 64, 66, which via one channel each are connected to corresponding openings 68, 70, 72, 74 arranged axially in sequence in the wall of the cylinder chamber 20. The slide 44 is provided with a conically turned cavity 76 on a level with the grooves 60, 64, 66.

When the chamber 20 is brought into communication with the high pressure channel 26 via the distrubuting valve and the channel 31, the piston 14 is moved rearwardly by the pressure liquid. Each of the openings 68, 70, 72, 74 will in turn be uncovered by the piston 14 at the piston area 24 and brought into communication with the chamber 20. The high pressure liquid is then conducted to the corresponding groove 60, 62, 64 and 66, respectively, in the cylinder space 46 and therefrom via the channel 40 to the pressure control input 38 of the distributing valve 32. The valve slide 33 in the distributing valve will then change position so that the chamber 18 via the channel 29 and the distributing valve will be connected to the high pressure channel 26. The channel 31 is then simultaneously connected to the return channel 27 and the piston 14 will change its direction of movement. The stroke length of the piston 14 is thus defined by the one of the openings 68, 70, 72, 74, which first brings the chamber 20 into communication with the cylinder space 46 of the distributing valve via the corresponding grooves 60, 62, 64 and 66, respectively.

This in turn depends from the difference between the force of the spring 48 on the slide 44 and the opposing force caused by the sum of the pressures in the chambers 52 and 54. The control valve is so designed that the slide 44 cannot close the groove 66, this connection therefore determining the greatest stroke length of the piston 14. The return stroke of the piston is initiated when the piston area 22 during the working stroke uncovers the inlet of the channel 36 into the chamber 18, so that the high pressure present in said chamber is conducted to the pressure control input 34 of the distributing valve and thereby the position of the slide 33 is switched. The piston 14 in addition has a recess 78. A channel 80, which is in permanent communication with the low pressure channel 28 via the distributing valve secures that the distributing valve is drained through the recess 78, by the channel 80 being in turn connected to the opening 74 and the channel 36, respectively.

From the description above it should be evident that when the pressure increases in one or both of the high pressure channels of the rotary motor and the percussion motor, respectively, the stroke length of the piston 14 will be reduced, while on the contrary the impact frequency will increase. When the pressure is reduced, the stroke length of the piston will increase and the impact frequency will be reduced. During drilling in homogenous and evenly hard rocks the pressure in the high pressure channel 23 of the rotary motor 6 is determined by the resistance to rotation of the drill 4. In operation a pressure will be present in the high pressure channel 26 of the percussion motor, which gives the slide 44 a corresponding position and the impact motor a predetermined stroke length. Should the resistance to rotation of the drill increase, the pressure will rise in the high pressure channel 23 of the rotary motor. Through the channel 57 and the cylinder space 52 the pressure increase will cause a displacement of the slide 44, the stroke length of the piston 14 thereby being shortened and thus the impact energy being reduced. In a corresponding manner the stroke length and thereby the impact energy will increase upon a reduction of the resistance to rotation. The impact energy of the drilling machine is thus automatically controlled and is dependent of the resistance to rotation of the drill, which in turn depends on the nature of rock. The impact stroke length can also be manually adjusted by means of the screw 50.

The device described operates independently of changes in the viscosity of the oil and independently of the degree of wear of the machine. Since the percussion motor is driven by a pump with a constant displacement, the pressure of the liquid will correspond to a predetermined stroke length and a predetermined impact frequency. Should the pressure decrease due to a reduction of the viscosity or an increased leak oil flow due to wear, the position of the slide 44 will be changed automatically, whereby the stroke length of the piston will be lengthened and reduction of the impact energy avoided. Since the rotary motor and the percussion motor are supplied by separate hydraulic circuits, the frequencies thereof can be controlled individually by controlling the liquid flow through the respective motor. By means of the conically turned cavity 76 of the slide 44 the communication between the grooves will be successively opened and thereby a step-less control of the stroke-length will be obtained.

The slide of the control valve can also be arranged so that the pressure present in the high pressure channel of the percussion motor tends to lengthen the stroke of the plunger. This embodiment is applicable, when the hydraulic circuit of the percussion motor has been provided with a separate pressure control valve (constant pressure control). The adjustment of the stroke length can also be made dependent on the pressure present in the high pressure channel of the rotary motor and by manual adjustment. The number of the annular grooves located in the cylinder space 46 is, of course, not limited to the number illustrated but may be both larger and smaller.

Figure 2:
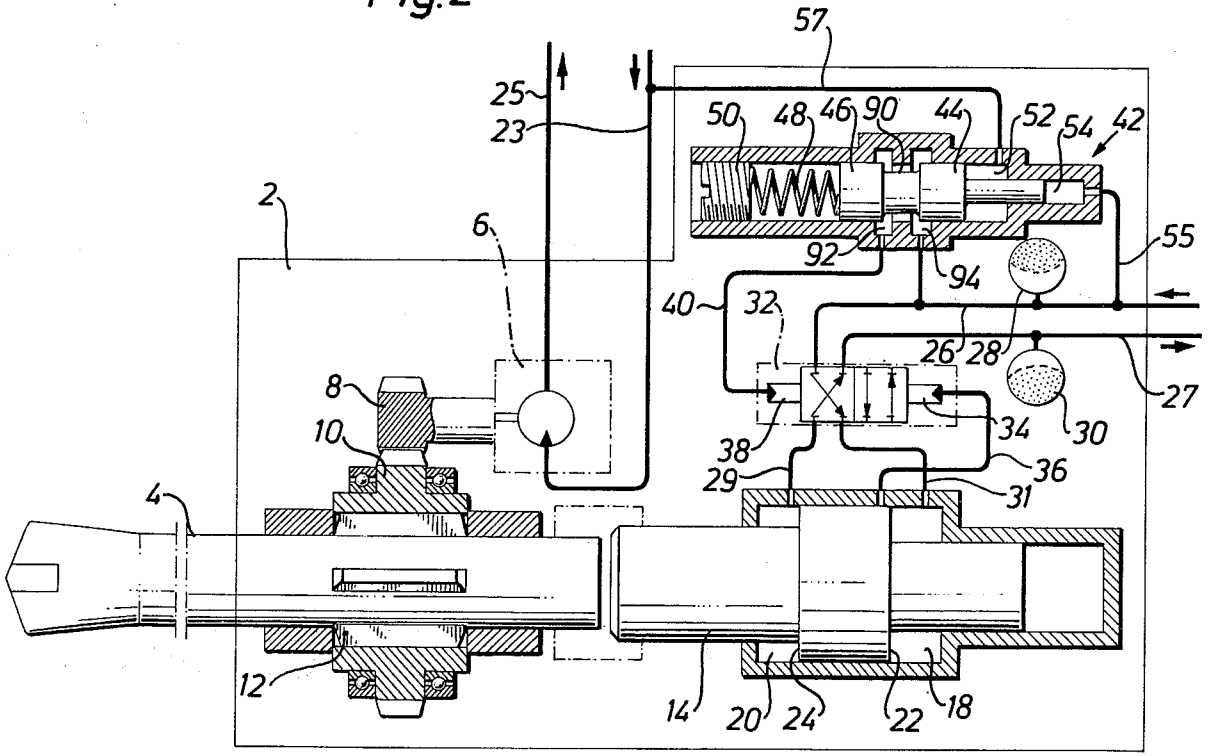

In the embodiment shown in FIG. 2 the slide 44 of the control valve 42 comprises a recess 90. Two grooves 92 and 94, respectively, in the wall of the cylinder space 46 can be brought into communication with each other via the recess 90. The groove 92 is connected via the channel 40 to the control pressure input 38 of the distributing valve 32 and the groove 94 is connected to the high pressure channel 26 of the hydraulic circuit of the percussion motor.

This embodiment differs from the embodiment according to FIG. 1 in that, instead of varying the stroke length of the piston, the working pressure in the chamber 18 is varied in depence from the pressures at the high pressure sides of the hydraulic circuits of the rotary motor and the percussion motor. The function of the arrangment according to FIG. 2 is also based upon the fact that a varying pressure occurs in the hydraulic circuit of the percussion motor, dispite the presence of pressure accumulators. These pressure variations depend on the relationship between the capacity of hydraulic pump used for the hydraulic current of the percussion motor, the displacement of the percussion motor, and fluid flow losses in valves and channels. More particularly the arrangment operates in the following manner.

In the position illustrated the distributing valve 32 is set so that the high pressure channel 26 is connected to the pressure chamber 18 and the impact piston 14 thus performs a working stroke. The hydraulic liquid in the chamber 20 is discharged through the distributing valve 32 to the low pressure channel 27. During the working stroke the pressure in the high pressure channel 26 decreases continuously, since the volume of the chamber 18 increases, which causes that also the pressure in the pressure chamber 54 of the control valve decreases, and the slide 44 is thereby displaced under the action of the compression spring 48 so that the communication between the grooves 92 and 94 is interrupted. At the end of the working stroke the piston area 22 uncovers the input of the channel 36 to the chamber 18 and the pressure present in the chamber 18 will act at the control pressure input 34 of the distributing valve to connect the high pressure channel via the channel 29 to the chamber 20 and the low pressure channel via the channel 31 to the chamber 18, whereby a return stroke is initiated. During the return stroke the pressure in the high pressure channel increases and the connection from the chamber 18 to the pressure control input 34 is interrupted by the piston 14. When the pressure increase in the high pressure channel 26, and thereby also in the chamber 54 of the control valve, has attained a predetermined value, the slide 44 will again open the connection between the grooves 92 and 94 and the high pressure in the high pressure channel will act via said grooves, the channel 40 and the control pressure input 38 of the distributing valve, so that the valve is switched again at the same time as the piston 14 has terminated its return stroke. A new working stroke is then initiated.

The pressures present in the high pressure channels of both motors and thus tending to move the slide 44 against the force of the spring 48 so that the connection between the high pressure channel 26 and the control channel 40 is opened. The impact energy supplied by the impact piston will then be determined by the working pressures of both motors. If the bias of the spring 48 is increased by means of the adjustment screw 50, a higher pressure is required in the high pressure channel 26, provided that the resistance to rotation is unchanged, for bringing the slide 44 to assume the position wherein the connection between the channel 26 and the channel 40 is opened via the grooves 92 and 94. Said higher working pressure will at the same time impart to the piston an increased impact energy. If the resistance to rotation of the drill steel should increase, the pressure in the high pressure channel of the rotary motor will increase causing an increase of the pressure also in the chamber 52. A corresponding lower pressure in the chamber 54 will then be required for displacing the slide so that the communication between the grooves 92 and 94 is opened. The reduction of the working pressure will cause a reduction of the impact energy. In a corresponding manner the working pressure required by the impact motor and the impact energy supplied will be increased when the resistance to rotation is reduced. In other words the pressure in the chamber 52 determines the point on the curve of the pulsating pressure in the channel 26, at which the connection to the control input 38 should be opened.

The impact energy of the drilling machine is thus automatically controlled and is dependent of the resistance to rotation of the drill steel, this in turn being dependent of the nature of rock. As the rotary motor and the percussion motor are supplied via separate hydraulic circuits, the frequencies thereof can be individually controlled by controlling the liquid flow in the respective motor, as was also the case in the first embodiment.

The slide of the control valve can also be arranged so that, upon an increasing pressure in the high pressure channel, said pressure increase tends to close the communication between the high pressure channel and the control channel connected to the pressure control input of the distributing valve. This communication can also be provided so that it is dependent of the position of the impact piston.

Figure 3:
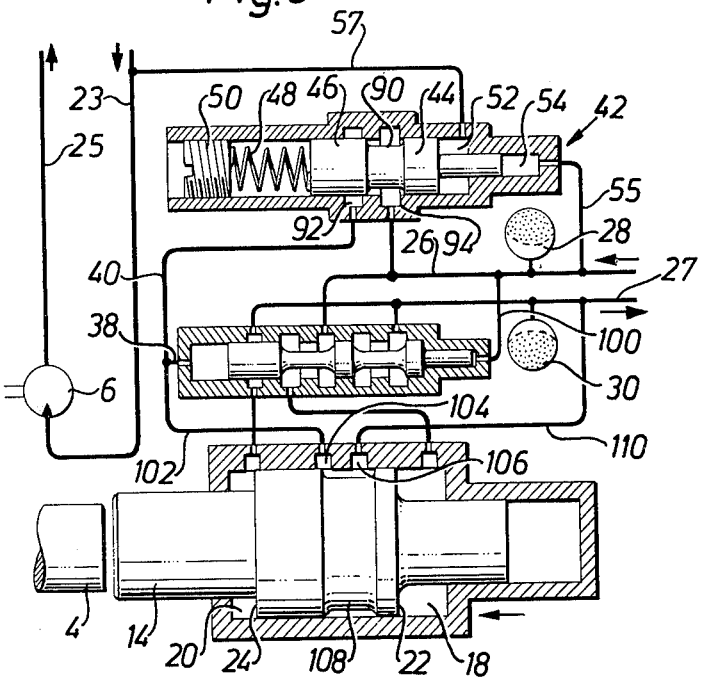

The modification illustrated in FIG. 3 of the embodiment according to FIG. 2 has the same manner of operation as this eariler embodiment and differs only slightly in respect of the solution of the hydraulic connection techniques, at the same time as the distributing valve and the connections thereof are shown more in detail. Both pressure control inputs of the distributing valve are controlled by the pressure in the high pressure channel 26, i.e., the pressure control input 34 is permanently connected via a channel 100 to the high pressure channel 26, while the connection of the pressure control input 38 as previously is via the control valve 42. However, the slide of the distributing valve is designed with different diameters at the end surface. In addition, the draining at the pressure control input 38 is performed via a channel 102, connections 104 and 106 to the cylinder space 16, an annular recess 108 on the piston 14 and a channel 110 to the low pressure channel 28.

Similar to the embodiment according to FIG. 2, the modification according to FIG. 3 operates with the pressure variations in the high pressure channel 26, which arise due to the pulsating flow through the percussion motor. A suitable dimensioning of the lines, accumulators and channels may, as in the embodiment according to FIG. 2, influence the curve of said pulsating flow.

The embodiments described above can also be applied to other types of rock drilling machines, e.g., where one pressure space is constantly in communication with the high pressure channel or where, in addition to the control valve, additional auxiliary valves are provided. Such an auxiliary valve may, e.g., be a pressure limiting valve in the percussion motor, which valve may be mounted together with the slide of the control valve or be made completely separate from the control valve. It is also possible to utilize an automatic restriction in the pressure channel of the percussion motor.

Examples of such and other modifications are illustrated schematically in FIG. 4 through 8.

Figure 4:
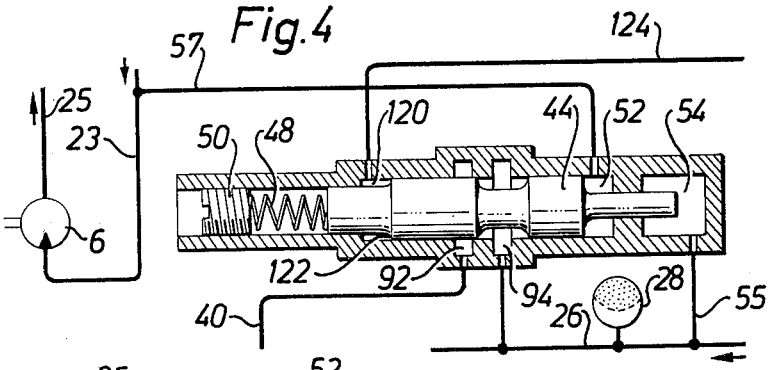

In FIG. 4 a modification of the embodiments shown in FIG. 2 and 3 is illustrated, wherein the high pressure at the high pressure side of the hydraulic circuit of the percussion motor can be remotely controlled. The control valve 42 at the end thereof adjacent the compression spring 48 comprises a pressure chamber 120. The pressure in the chamber 120 acts against a slide area 122 so as to tend to displace the slide 44 in the right-hand direction in cooperation with the spring pressure. A pressure channel 124 is connected to the chamber 120. The pressure in the chamber 120 can be controlled via the channel 124 to control the pressure in the high pressure channel 26 as required for opening the communication between the grooves 92 and 94. The arrangement with a pressure chamber 120 and a pressure channel 124 may also completely replace the spring 48 and the adjustment screw 50. Also in the embodiment according to FIG. 1 the arrangement according to FIG. 4 may be used.

Figure 5:
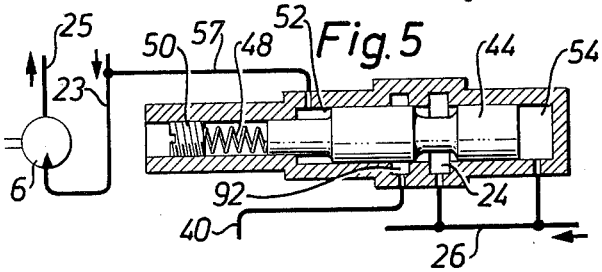

In FIG. 5 an embodiment is shown, wherein the pressures in the respective high pressure line of the hydraulic circuits are counteracting each other on the slide 44. Even if shown as applied in the devices according to FIG. 2 or 3, this modification may also be of interest in the embodiment according to FIG. 1. In the device according to FIG. 5 a pressure increase in the high pressure channel of the rotary motor will act so that it tends to close the communication between the grooves 92 and 94. This embodiment can be used in long-hole drilling, where the length of the bore causes a successively increasing resistance to rotation and an increased pressure in the high pressure channel of the rotary motor. This increased pressure, however, also causes an increase of the pressure required in the high pressure channel 26 to open the communication between the grooves 92 and 94 and thereby an increase of the impact energy. This increase of the impact energy is required in order to transfer to the drill bit sufficient impact energy through the long drilling equipment. When applied to the embodiment according to FIG. 1 a corresponding design should increase the stroke length of the piston and thereby likewise the impact energy thereof.

Figure 6:
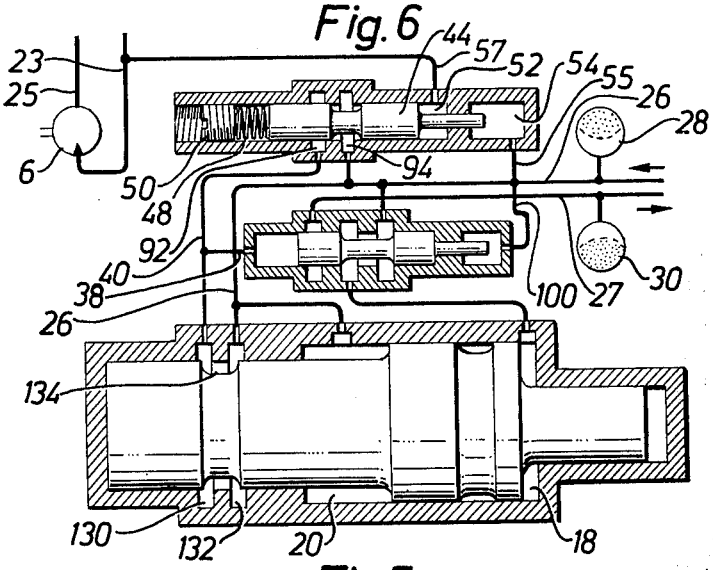

The embodiment illustrated in FIG. 6 differs principally from the embodiments according to FIG. 2 and 3 in that the impact piston in the rearmost position thereof acts as a valve, which, bypassing in control valve, connects the pressure control input 38 to the high pressure channel 26. For this purpose the cylinder room for the impact piston has two annular grooves 130, 132, the first of which is connected to the control pressure channel 40 and the latter to the high pressure channel 26. Further, the piston has an annular recess 134. When the impact piston is in its rearmost position, the recess 134 connects the two grooves 130 and 132 with each other so that the communication to the control pressure input 38 is opened independently of the system pressure channel 26 but the piston area 24 in the chamber 20 is smaller than the piston area 22 in the chamber 18. If the control valve 42 should open the communication between the grooves 92 and 94, before the piston has reached its rearmost position during the return stroke, this condition means a shortening of the stroke length of the piston.

Figure 7:
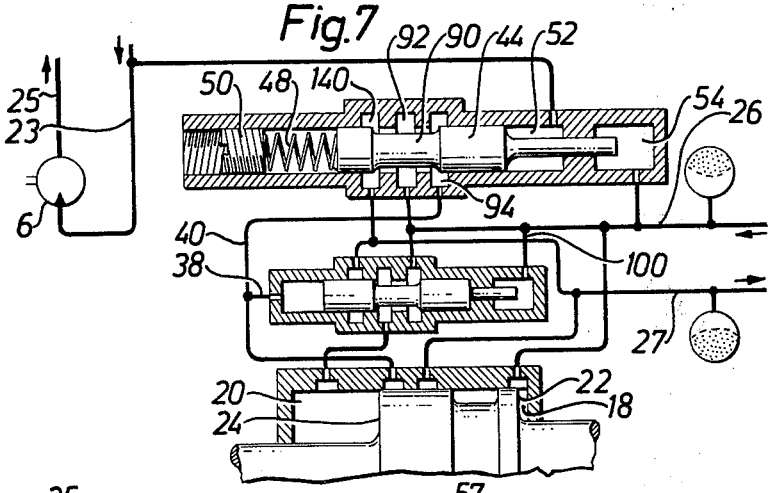

In FIG. 7 an example of a pressure limiting valve is shown, which in this case is combined with the control valve 42. For this purpose the control valve in addition to the grooves 92 and 94 comprises a further groove 140 communicating with the low pressure channel 27. Further, the chamber 18 communicates continuously with the high pressure channel 26, the piston area 24 being larger than the piston area 22. If, during the return stroke of the piston, the pulsating pressure in the chamber 26 should rise too much, the communication between the grooves 92 and 140 is opened, immediately causing a pressure reduction in the high pressure channel 26, since it is connected with the low pressure channel.

Figure 8:
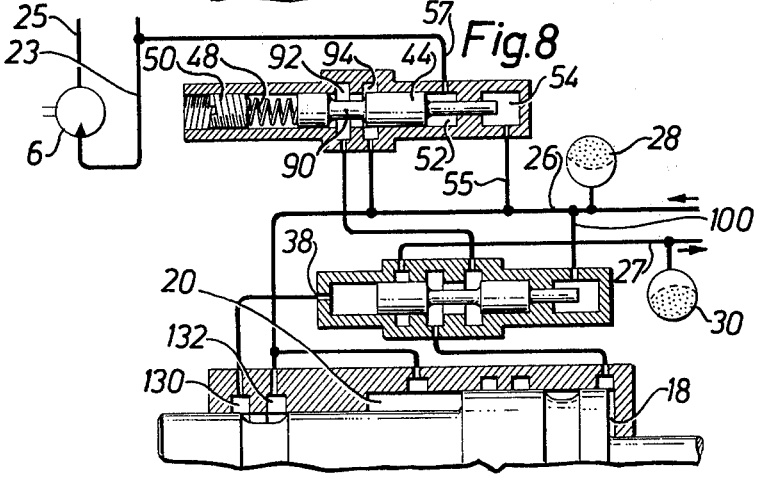

In the modification, schematically illustrated in FIG. 8 of the embodiment according to FIG. 6, the control valve 42, responsive to the high pressure in the line 26, operates as a restriction valve, for the pressure liquid supplied via the distributing valve to the chamber 18. For this purpose the groove 92 is connected with the distributing valve in the manner illustrated instead of being connected to the control pressure input 38 as in the preceeding embodiments. When the pressure in the high pressure channel 26, and thereby in the chamber 54 is increased, the flow cross section in the groove 94 is reduced by the slide 44 being displaced to the left.

I claim:

1. A rock drilling apparatus, comprising a machine housing, means for mounting a drill in said housing, a hydraulically operated rotary motor for rotating said drill, a percussion motor with an impact piston hydraulically operable to perform a power stroke to and a return stroke from said drill for transferring impact energy thereto; said piston defining together with said machine housing first and second pressure chambers for receiving pressure liquid to move said piston to and from the drill, respectively, said percussion motor having a hydraulic circuit including a high pressure side and a low pressure side, a pressure liquid distributing valve having a control input for receiving a control pressure, said distributing valve being located in said hydraulic circuit of the percussion motor for alternately connecting at least one of said pressure chambers to the high pressure side and low pressure side, respectively, of said hydraulic circuit in response to said control pressure, said rotary motor having a hydraulic circuit separate from said hydraulic circuit of the percussion motor and including a high pressure side and a low pressure side separate from the high and low pressure sides of the percussion motor, and a control valve for controlling said control pressure in response to the pressure at the high pressure side of said rotary motor, the control valve being responsive to the pressures at the high pressure sides of both hydraulic circuits to open and close a control pressure supply line to said control input of said distributing valve for controlling the connection of the high pressure side of the hydraulic circuit of the percussion motor to said first chamber, via said distributing valve.

2. Apparatus according to claim 1, characterized in that the control valve comprising a valve slide movable in a valve housing and adapted to open or close said pressure supply line, said valve slide being adhystably biased for affecting the volume of two separate valve chambers defined between said valve slide and said valve housing and connected to one each of the high pressure sides of the two hydraulic circuits.

3. Apparatus according to claim 2, characterized in that said valve slide is adjustably biased to reduce the volume of said two separate valve chambers.

4. Apparatus according to claim 2, characterized in that said valve slide is adjustably biased to increase the volume of the valve chamber connected to the hydraulic circuit of the rotary motor, and to reduce the volume of the valve chamber connected to the hydraulic circuit of the percussion motor.

5. Apparatus according to claim 2, characterized in that said valve slide is adjustably biased by means of a compression spring, the spring tension of which is adjustable.

6. Apparatus according to claim 2, characterized in that said control valve comprises a control pressure chamber, the pressure of which counteracts the pressures in said valve chambers.

7. Apparatus according to claim 1, characterized in that said pressure supply line connects the high pressure side of the hydraulic circuit of the impact piston with the control input via the control valve.

8. Apparatus according to claim 1, characterized by means connecting the hydraulic circuit of the percussion motor to said pressure chambers so that the pressure at the high pressure side of the hydraulic circuit of the percussion motor increases during the return stroke and decreases during the power stroke of the impact piston.

9. Apparatus according to claim 8, characterized in that the control valve includes means for also limiting the pressure of the high pressure side of the percussion motor in response to the pressure at the high pressure side of the rotary motor.

10. Apparatus according to claim 1, characterized by valve means defined by said impact piston and said machine housing for bypassing, in the rearmost position of said impact piston, said control valve and connecting said control to said pressure supply line.

11. A rock drilling apparatus, comprising a machine housing, means for mounting a drill in said housing, a hydraulically operated rotary motor for rotating said drill, a percussion motor with an impact piston hydraulically operable to perform a power stroke to and a return from said drill for tranferring impact energy thereto, said piston defining together with said machine housing first and second pressure chambers for receiving pressure liquid to move said piston to and from the drill, respectively, said percussion motor having a hydraulic circuit including a high pressure side and a low pressure side, a pressure liquid distributing valve having a control input for receiving a control pressure, said distributing valve being located in said hydraulic circuit of the percussion motor for alternately connecting at least one of said pressure chambers to the high pressure side and low pressure side, respectively, of said hydraulic circuit in response to said control pressure, said rotary motor having a hydraulic circuit separate from said hydraulic circuit of the percussion motor and including a high pressure side and a low pressure side separate from the high and low pressure sides of the percussion motor, and a control valve for controlling said control pressure in response to the pressure at the high pressure side of said rotary motor, said control valve and said impact piston including means cooperating for controlling the stroke length of the impact piston.

12. Apparatus according to claim 11, characterized in that a number of outputs for the pressure liquid supplied to said second chamber via said distributing valve are arranged after each other in said second chamber in the direction of movement of said impact piston, said impact piston being arranged to uncover said outputs in turn during the return stroke thereof, said outputs being connected as parallel inputs to said control valve, said control valve having an output connected to a control input of said distributing valve; said control input controlling the switching of the distributing valve to a condition for connecting the high pressure side of the hydraulic circuit of the percussion motor to said first chamber, said control valve in response to the pressure at the high pressure side of the hydraulic circuit of the rotary motor being arranged to block a number of said parallel inputs, corresponding to an equal number of said outputs in said second chamber in sequence as counted from the first one in the direction of the return stroke.

13. Apparatus according to claim 12, characterized in that said control valve is responsive to the pressures at the high pressure sides of both hydraulic circuits.

14. Apparatus according to claim 13, characterized in that said control valve comprises a valve slide movable in a bore in a valve housing and adjustably biased to affect the volume of two separate valve chambers defined between said valve slide and said valve housing and connected to one each of the high pressure slides of the two hydraulic circuits, said inputs being connected after each other to said bore, in the direction of movement of said valve slide, in the same sequence as said outputs of said second chamber.

15. Apparatus according to claim 14, characterized in that said valve slide is adjustably biased to reduce the volume of both said valve chambers.

16. Apparatus according to claim 14, characterized in that said valve slide is adjustably biased to increase the volume of the valve chamber connected to the hydraulic circuit of the rotary motor and to reduce the volume of the other valve chamber.

17. Apparatus according to claim 14, characterized in that said valve slide on a level with said inputs has a recess tapering conically with the wall of said bore.

18. A rock drilling apparatus, comprising a machine housing, means for mounting a drill in said housing, a hydraulically operated rotary motor for rotating said drill, a percussion motor with an impact piston hydraulically operable to perform a power stroke to and a return stroke from said drill for transferring impact energy thereto, said piston defining together with said machine housing first and second pressure chambers for receiving pressure liquid to move said piston to and from the drill, respectively, said percussion motor having a hydraulic circuit including a high pressure side and a low pressure side, a pressure liquid distributing valve having a control input for receiving a control pressure, said distributing valve being located in said hydraulic circuit of said percussion motor for alternately connecting said first pressure chamber to the high pressure side and the low pressure side, respectively, of said hydraulic circuit in response to said control pressure, said rotary motor having a hydraulic circuit separate from said hydraulic circuit of the percussion motor and including a high pressure side and a low pressure side, a control valve for controlling the supply of pressure fluid via said distributing valve to said first pressure chamber in response to the pressures at the high pressure sides of both hydraulic circuits, said impact piston and said machine housing defining valve means connecting said high pressure side of said hydraulic circuit of the percussion motor with said control input in the rearmost position of said impact piston.

* * * * *